United States Patent [19]

East et al.

[11] Patent Number: 4,794,777

[45] Date of Patent: Jan. 3, 1989

[54] CONTINUOUS EXTRUSION OF METALS

[75] Inventors: John East, Wantage; Ian Maxwell, Reading, both of England

[73] Assignee: Metal Box Public Limited Company, United Kingdom

[21] Appl. No.: 871,380

[22] Filed: Jun. 6, 1986

Related U.S. Application Data

[63] Continuation-in-part of Ser. No. 574,511, Jan. 27, 1984, Pat. No. 4,610,725.

[30] Foreign Application Priority Data

Feb. 3, 1983 [GB] United Kingdom ..... 8302951
Apr. 12, 1983 [GB] United Kingdom ..... 8309836

[51] Int. Cl.[4] ..... B21C 23/00; B21C 29/00

[52] U.S. Cl. ..... 73/262; 82/1 C; 82/7; 29/445; 29/463; 73/101 R

[58] Field of Search ..... 72/253.1, 262, 200, 72/366; 76/107 R, 101; 29/527.6, 445, 463, 121.1, 159 R, 129.5; 82/2 A, 7, 1 C

[56] References Cited

U.S. PATENT DOCUMENTS

| | | | |
|---|---|---|---|
| 2,124,360 | 7/1938 | Welty | 29/156.5 R |
| 3,380,139 | 4/1968 | Kis et al. | 29/527.6 |
| 3,533,329 | 10/1976 | Galli | 29/527.6 |
| 4,079,661 | 3/1978 | Goloff | 29/527.6 |
| 4,212,177 | 7/1980 | Fuchs, Jr. | 72/60 |
| 4,650,408 | 3/1987 | Anderson et al. | 72/262 |

FOREIGN PATENT DOCUMENTS

| | | | |
|---|---|---|---|
| 2028207 | 3/1980 | United Kingdom | 72/262 |
| 2087301 | 5/1982 | United Kingdom | 72/262 |

OTHER PUBLICATIONS

WO 8300452; Feb. 17, 1983; Anderson et al.; published under PCT.

*Primary Examiner*—Lowell A. Larson
*Attorney, Agent, or Firm*—Berman, Aisenberg & Platt

[57] ABSTRACT

A rotary wheel member for use in a rotary, friction type, continuous extrusion apparatus is produced by (a) producing a rotary wheel having formed in its cylindrical peripheral portion a continuous groove, and secured in that groove for movement with the wheel a solid annular metal mass;

(b) rotating the wheel about its rotary axis; and (c) applying to the periphery of the annular metal mass a tool of predetermined end shape, and progressively advancing the tool in a radial direction as the wheel continues to rotate, thus machining in the peripheral portion of the annular metal mass a working groove of predetermined transverse cross section. The peripheral portion of the annular metal mass which define the working groove are of a composition which is substantially the same as that of a feedstock metal that is to be extruded in such apparatus when equipped with the wheel member the end shape of the tool is substantially the same as that of an abutment member which is to be used in that apparatus to close the end of an arcuate passageway which is formed in the working groove by a shoe member which co-operates with said cylindrical periphery of the wheel member.

13 Claims, 5 Drawing Sheets

CONTINUOUS EXTRUSION OF METALS

The present application constitutes a continuation-in-part of the pending application Ser. No. 574,511 filed Jan. 27th 1984, now U.S. Pat. No. 4,610,725, by John East and Ian Maxwell.

TECHNICAL FIELD

This invention relates to an apparatus for effecting continuous extrusion of metal from a feedstock in particulate, comminuted or solid form, which apparatus includes:

(a) a rotatable wheel member arranged for rotation when in operation by a driving means, said wheel member having formed peripherally thereon a continuous circumferential groove;

(b) a cooperating shoe member which extends circumferentially around a substantial part of the periphery of said wheel member and which has a portion which projects in a radial direction partly into said groove with small working clearance from the side walls of said groove, said shoe member portion defining with the walls of said groove an enclosed passageway extending circumferentially of said wheel member;

(c) feedstock inlet means disposed at an inlet end of said passageway for enabling feedstock to enter said passageway at said inlet end whereby to be engaged and carried frictionally by said wheel member, when rotating, towards the opposite, outlet end of said passageway;

(d) an abutment member carried on said shoe member and projecting radially into said passageway at said outlet end thereof so as to substantially close said passageway at that end and thereby impede the passage of feedstock frictionally carried in said groove by said wheel member, thus creating an extrusion pressure in said passageway at said outlet end thereof; and (e) a die member carried on said shoe member and having a die orifice opening from said passageway at said outlet end thereof, through which orifice feedstock carried in said groove and frictionally compressed by rotation of said wheel member, when driven, is compressed and extruded in continuous form, to exit from said shoe member via an outlet aperture.

The invention is particularly concerned with a method of producing a said rotatable wheel member for use in such a rotary, friction-type, continuous extrusion apparatus.

BACKGROUND ART

In operating such an extrusion apparatus, the parts defining said passageway adjacent said outlet end thereof suffer very great working loads and very high operating temperatures. Of such highly stressed (mechanically and thermally) parts, those that suffer greatest wear or damage are the stationary, feedstock-engaging parts of, or associated with, said stationary shoe member, particularly on said abutment member, said die member and the stationary parts that support those items.

For the convenience of readily making good worn or damaged surfaces or parts, the abutment member, and the die member and its supporting parts are made as separate replaceable items which are rigidly but removably secured in the stationary shoe member.

In order to reduce the temperatures at which those replaceable items operate, such items have been provided with internal cooling passages through which cooling water has been circulated. However, such cooling measures have not been very effective, for the reasons that (a) the small sizes of those items and the high mechanical loads to which they are subjected have severely restricted both the sizes of the internal cooling passages and their proximity to the source of heat, so that the cooling water has been unable to extract heat at an adequate rate, and (b) the materials used for such small items (e.g. high-speed tool steels) have relatively poor heat transmission properties.

As a consequence of the low dissipation of heat by the cooling water, plastic flow of the tip of the abutment member, at its free end adjoining the bottom of the groove in the wheel member, has been experienced, due to the excessive tip temperatures reached. This has severely limited the life of the abutment member, and the running time of the apparatus between successive occasions when the abutment member has to be replaced. This in turn has led to a reduction in the quantity of the output extrusion product produced, due to the down-time during which the apparatus cannot be operated.

Also, with prolonged use, there has been the risk that the extrusion die may overheat to a temperature at which its mechanical strength is impaired, with the consequent risk of deformation and/or increased wear of the die.

After experimentation with various different arrangements of internal cooling passages, particularly in the abutment member, highly satisfactory results have now been achieved by means of an entirely different arrangement for cooling the abutment member. Such different arrangement, and various modifications thereof, have been described and claimed in the copending, parent patent application No. 574,511, filed Jan. 27, 1984, now U.S. Pat. No. 4,610,725, from which application this present application has been divided.

The use of the invention of that parent application enables such a rotary, friction-type, continuous extrusion apparatus to operate at lower temperatures, for longer periods of time, and with longer operating lives for those parts of the apparatus that are subjected to high mechanical and thermal stresses.

The beneficial results obtained by the use of that invention can be enhanced by the use in conjunction therewith of the invention of this divisional application.

By way of introduction to the present invention, reference should be made to the passage in the specification of that parent application, which begins—"It is believed that the highly beneficial ..." and ends—"... at which heat will be conveyed to the cooling zone by the wheel member."

That passage appears later in this specification, since the description given later with reference to the drawing figures is the same as that given in said parent application.

DISCLOSURE OF INVENTION

According to the present invention, a method of producing a rotary wheel member adapted for use, in a rotary, friction type, continuous extrusion apparatus comprises the steps of:

(a) producing a rotary wheel having formed in its cylindrical peripheral parts a continuous, radially-extending groove, and secured in that groove for movement with said peripheral parts of said wheelan annular metal mass;

(b) rotating said wheel about its rotary axis; and (c) applying to the periphery of said annular metal mass secured in said wheel a tool of predetermined end shape, and progressively advancing said tool in a radial direction as said wheel continues to rotate whereby to machine in the peripheral parts of said annular metal mass a working groove of predetermined desired transverse cross sectional shape;

said peripheral parts of said annular metal mass which define said working groove being of a composition which is substantially the same as that of a predetermined feedstock metal that is to be extruded in a said apparatus when equipped with the wheel member so produced; and said predetermined end shape of said tool being substantially the same as that of a predetermined abutment member which is to be used in that apparatus to close the end of an arcuate passageway which is formed in said working groove by a shoe member which when the apparatus is in operation co-operates with said cylindrical peripheral parts of said wheel member.

Preferably, said annular metal mass secured in said wheel groove is in good thermal relationship with said wheel.

Said annular metal mass secured in said wheel groove may comprise an annulus of a first predetermined metal lying concentrically with said wheel in said wheel groove and being enveloped within a sheath of a second predetermined metal, said second predetermined metal defining said working groove and being in good thermal relationship with said first predetermined metal.

Said annular metal mass secured in said wheel groove may alternatively comprise an annulus of a first predetermined metal lying concentric with said wheel in the bottom of said wheel groove and being overlaid by a second annulus of a second predetermined metal, said first predetermined metal being in good thermal relationship with said second predetermined metal, and said second predetermined metal defining said working groove.

Preferably, said first and second predetermined metals each have a product of thermal conductivity and specific heat per unit volume that is greater than that of the material of the wheel.

Advantageously, said product for said first predetermined metal is greater than that for said second predetermined metal.

In carrying out the methods of the present invention, said wheel is preferably mounted for rotation in a said rotary extrusion apparatus, and is rotated therein, and said tool comprises a said abutment member of said apparatus, which abutment member is advanced radially into said annular metal mass as said wheel is rotated, whereby to form said working groove.

The present invention also provides wheel members prepared by methods according to the present invention.

Other features and advantages of the present invention will appear from a reading of the description that follows hereafter, and from the claims appended at the end of that description.

BRIEF DESCRIPTION OF DRAWINGS

One continuous extrusion apparatus embodying the present invention will now be described by way of example and with reference to the accompanying diagrammatic drawings in which.

MODES OF CARRYING OUT THE INVENTION

Figure 1:
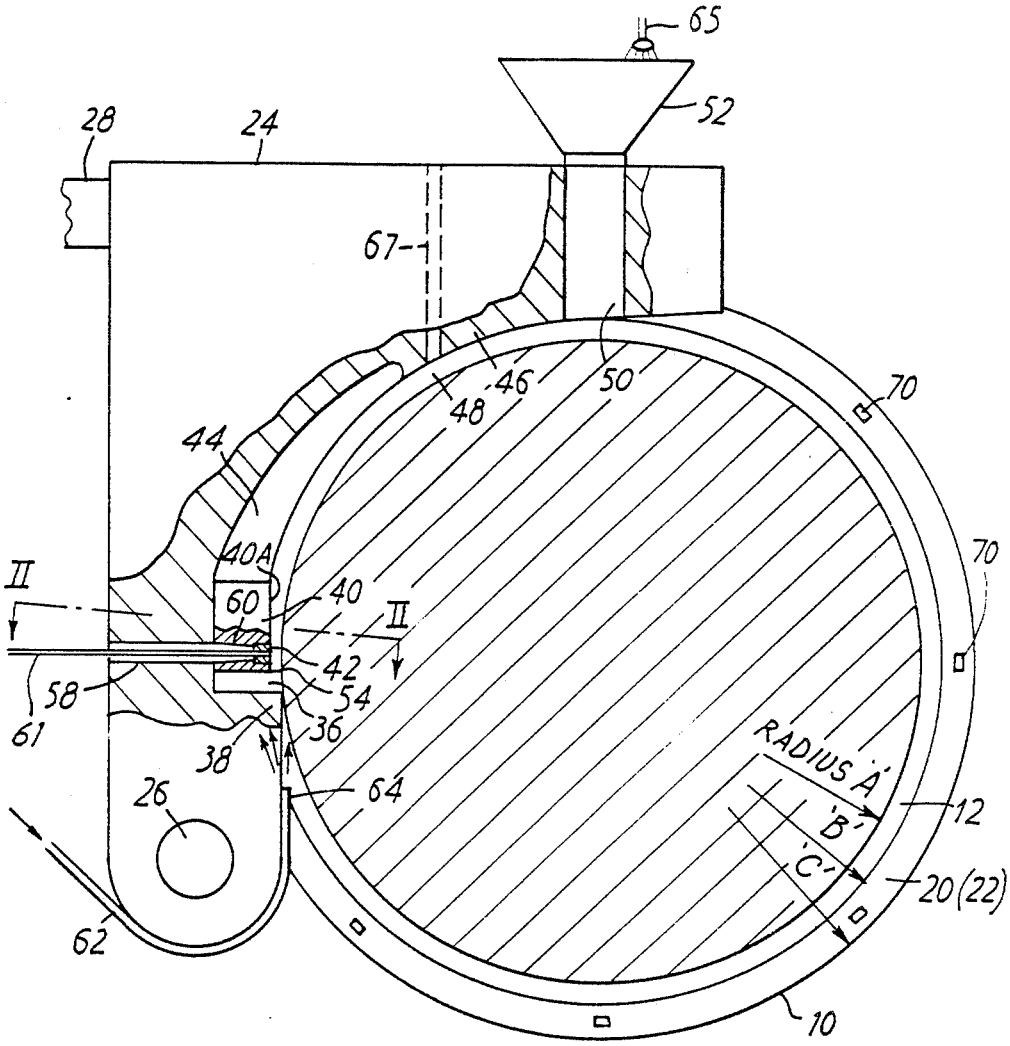
FIG. 1 shows a medial, vertical cross-section taken through the essential working parts of the apparatus, the plane of that section being indicated in FIG. 2 at I—I.
Figure 2:
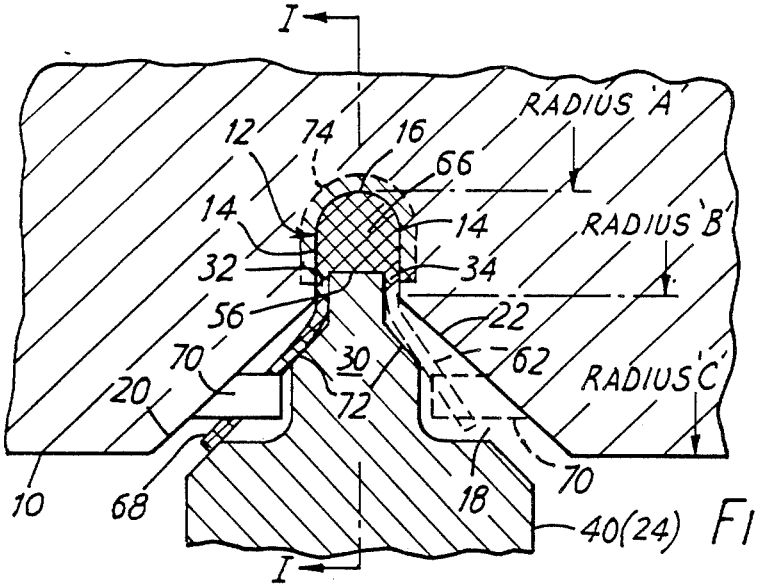
FIG. 2 shows a transverse sectional view taken on the section indicated in FIG. 1 at II—II.

Referring now to FIGS. 1 and 2, the apparatus there shown includes a rotatable wheel member 10 which is carried in bearings (not shown) and coupled through gearing (not shown) to an electric driving motor (not shown) so as to be driven when in operation at a selected speed within the range 0 to 20 RPM (though greater speeds are possible).

The wheel member has formed around its periphery a groove 12 whose radial cross-section is depicted in FIG. 2. The deeper part of the groove has parallel annular sides 14 which merge with a radiused bottom surface 16 of the groove. A convergent mouth part 18 of said groove is defined by oppositely-directed frusto-conical surfaces 20, 22.

A stationary shoe member 24 carried on a lower pivot pin 26 extends around and cooperates closely with approximately one quarter of the periphery of the wheel member 10. The shoe member is retained in its operating position as shown in FIG. 1 by a withdrawable stop member 28.

The shoe member includes centrally (in an axial direction) a circumferentially-extending projecting portion 30 which projects partly into the groove 12 in the wheel member 10 with small axial or transverse clearance gaps 32, 34 on either side. That projecting portion 30 is constituted in part by a series of replaceable inserts, and comprises a radially-directed abutment member 36, an abutment support 38 downstream of the abutment member, a die block 40 (incorporating an extrusion die 42) upstream of the abutment member, and an arcuate wear-resisting member 44 upstream of said die block. Upstream of the member 44 an integral entry part 46 of the shoe member completes an arcuate passageway 48 which extends around the wheel member from a vertically-oriented feedstock inlet passage 50 disposed below a feedstock hopper 52, downstream as far as the front face 54 of the abutment member 36. That passageway has a radial cross-section which in the FIG. 2 is defined by the annular side walls 14 and bottom surface 16 of the groove 12, and the inner surface 56 of the said central portion 30 of the shoe member 24.

The said abutment member 36, die block 40, die 42 and arcuate member 44 are all made of suitably hard, wear-resistant metals, e.g. high-speed tool steels.

The shoe member is provided with an outlet aperture 58 which is aligned with a corresponding aperture 60 formed in the die block 40 and through which the extruded output metal product 61 (e.g. a round wire) from the orifice of the die 42 emerges.

On rotation of the wheel member 10, comminuted feedstock admitted to the inlet end of the said arcuate passageway 48 from the hopper 52 via the inlet passage 50 is carried by the moving groove surfaces of the wheel member in an anti-clockwise dirction as seen in FIG. 1 along the length of said arcuate passageway 48, and is agglomerated and compacted to form a solid slug of metal devoid of interstices in the lower section of the passageway adjacent said die block 40. That slug of metal is continuously urged under great pressure against the abutment member by the frictional drag of the moving groove surfaces. That pressure is sufficient to extrude the metal of said slug through the orifice of the extrusion die and thereby provide an extruded output product which issues through the apertures 58 and 60 in the shoe member and die block. In the particular case, the output product comprises a bright copper wire produced from small chopped pieces of wire which constitute the said feedstock.

A water pipe 62 secured around the lower end of the shoe membeer 24 has an exit nozzle 64 positioned and secured on the side of the shoe member that lies adjacent the wheel member 10. The nozzle is aligned so as, when the pipe is supplied with cooling water, to direct a jet of water directly at the downstream parts of the abutment member where it lies in and abuts the groove 12 in the wheel member 10. Thus, the tip of the free end of the abutment member (where in operation most of the heat is generated) and the adjoining surfaces of the wheel member and groove are directly cooled by the flow thereover of water from the jet directed towards them.

The die block 40 is provided with internal water passages (not shown) and a supply of cooling water for enveloping the output product leaving the die and extracting some of the heat being carried away in that product. But no such internal passages are formed in the abutment member. Thus, the strength of that member is not reduced in the interests of providing internal water cooling for cooling that member.

If desired, the cooling of the apparatus may be enhanced by providing cooling water sprinklers 65 over the hopper 52 so as to feed some cooling water into the said arcuate passageway 48 with the comminutd feedstock.

In the FIG. 2, the slug of compacted metal in the extrusion zone adjacent the die block 40 is indicated at 66. From that metal slug, the output product is extruded through the extrusion die 42 by the pressure in that zone. That pressure also acts to extrude some of the metal through the said axial clearance gaps 32 and 34 between the side walls of the groove and the respective opposing surfaces of the die block and abutment member. That extruded metal gradually builds up in a radial direction to form strips 68 of waste metal or "flash". In order to prevent those waste strips growing too large to handle and control, a plurality of transversely-directed teeth 70 are secured on the divergent walls 20, 22 which constitute the said mouth 18 of the groove 12. Those teeth are uniformly spaced around the wheel member, the teeth on one of the walls being disposed opposite the corresponding teeth on the opposite wall. If desired, the teeth on one wall may alternatively be staggered relative to corresponding teeth on the other wall.

In operation, the inclined surfaces 72 of the die block 40 deflect the extruded waste strips 68 obliquely into the paths of the respective sets of moving teeth 70. Interception of such a waste strip 68 by a moving tooth causes a piece of that strip to be cut or otherwise torn away from the extruded metal in the clearance gap. Thus, such waste extruded strips are removed as soon as they extend radially far enough to be intercepted by a moving tooth. In this way the "flash" is prevented from reaching unmanageable proportions.

The said teeth do not need to be sharp, and can be secured in any satisfactory manner on the wheel member 10, e.g. by welding.

Figure 3:
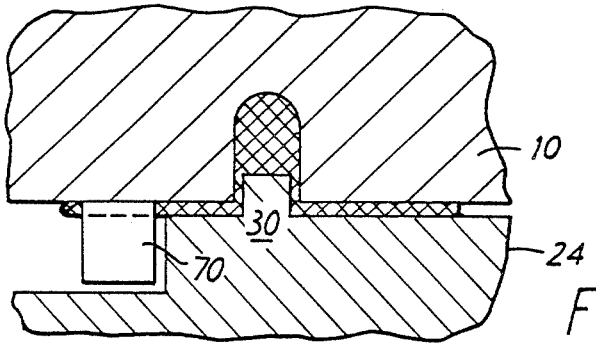
FIGS. 3 and 4 show in sectional views similar to that of FIG. 2 two arrangements which are alternatives to that of FIG. 2.
Figure 4:
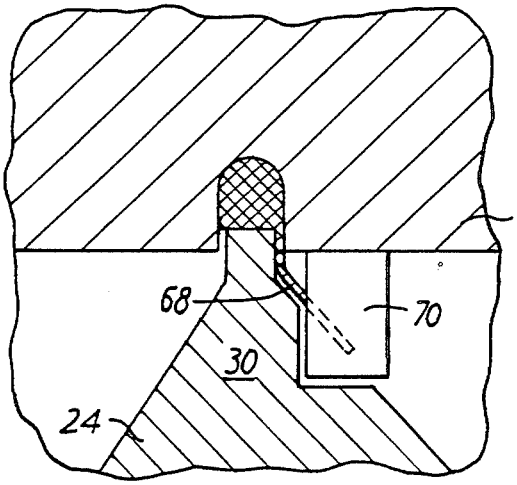

In the FIGS. 3 and 4 are shown other teeth fitted in analogous manners to appropriate surfaces of other forms of said wheel member 10.

In those alternative arrangments, the external surfaces of the wheel member 10 cooperate with correspondingly shaped surfaces of the cooperating shoe member 24 whereby to effect control of the flash in a particular desired way. In FIG. 3, the flash is caused to grow in a purely transverse or axial direction, until it is intercepted by a radially projecting tooth, whereupon that piece of flash is torn away from the extruded metal in the associated clearance gap.

In FIG. 4, the flash is caused to grow in an oblique direction (as in the case of FIG. 2), but is intercepted by teeth which project radially from the surface of the wheel member 10.

For various reasons that will appear later, it may be desirable, or even necessary, to treat the extrusion product (wire 61) issuing from the continuous extrusion apparatus described above in an extrusion product treatment apparatus before passing it to a product collection and storage means. Moreover, it may be desirable or advantageous to treat the extrusion product whilst it still remains hot from the continuous extrusion process in which it was produced.

Such a treatment apparatus may, for example, be arranged to provide the extrusion product with a better or different surface finish (for example, a drawn finish), and/or a more uniform external diameter or gauge. Such a treatment apparatus may also be used to provide, at different times, from the same continuous extrusion product, finished products of various different gauges and/or tolerances. For such purposes, the said treatment apparatus may comprise a simple drawing die through which said extrusion product is first threaded and then drawn under tension, to provide a said finished product of desired size, tolerance, and/or quality. The use of such a treatment apparatus to treat the extrusion product would enable the continuous extrusion die 42 of the continuous extrusion apparatus to be retained in service for a longer period before having to be discarded because of the excessive enlargement of its die aperture caused by wear in service. Moreover, such a treatment apparatus may have its die readily and speedily interchanged, whereby to enable an output product of a different gauge, tolerance and/or quality to be produced instead.

Figure 5:
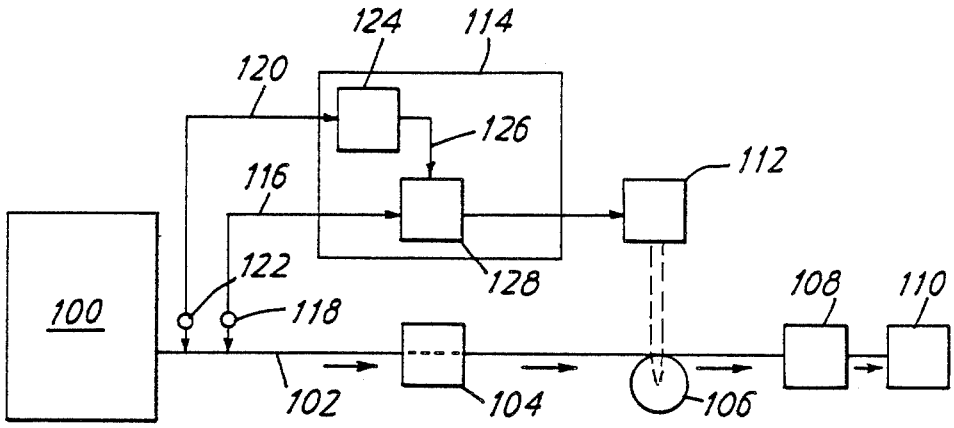
FIG. 5 shows a schematic block diagram of a system embodying the apparatus of the FIGS. 1 and 2.

One example of a continuous extrusion system incorporating a continuous extrusion apparatus and an extrusion product treatment apparatus will now be described with reference to the FIG. 5.

Referring now to the FIG. 5, the system there shown includes at reference 100 a continuous extrusion apparatus as just described above and, if desired, modified as described below, the output copper wire produced by that apparatus being indicated at 102, and being drawn through a sizing die 104 (for reducing its gauge to a desired lower value) by a tensioning pulley device 106 around which the wire passes a plurality of times before passing via an accummulator 108 to a coiler 110.

The pulley device 106 is coupled to the output shaft of an electrical torque motor 112 whose energisation is provided and controlled by a control apparatus 114. The latter is responsive to (a) a first electrical signal 116 derived from a wire tension sensor 118 which engages the wire 102 at a position between the extrusion apparatus 100 and the sizing die 104, and which provides as said first signal an electrical signal dependent on the tension in the wire 102 at the output of the extrusion apparatus 100; and to (b) a second electrical signal 120 derived from a temperature sensor 122 which measures the temperature of the wire 102 as it leaves the extrusion apparatus 100.

The control apparatus 114 incorporates a function generator 124 which is responsive to said second (temperature) signal 120 and provides at its output circuit a third electrical signal representative of the yield stress tension for the particular wire 102 when at the particular temperature represented by the said second (temperature) signal. That third electrical signal 126 is supplied as a reference signal to a comparator 128 (also part of said control apparatus) in which the said first (tension) signal 116 is compared with said third signal (yield stress tension). The output signal of the comparator constitutes the signal for controlling the energisation of the torque motor.

In operation, the torque motor is energised to an extent sufficient to maintain the tension in the wire leaving the extrusion apparatus 100 at a value which lies a predetermined amount below the yield stress tension for the particular wire at the particular temperature at which it leaves the extrusion apparatus.

Whereas in the description above reference has been made to the use of a water jet for cooling the abutment member tip, jets of other cooling liquids (or even cooling gases) could be used instead. Even jets of appropriate liquified gases may be used.

Regarding the flash-removing teeth 70 referred to in the above description, it should be noted that:

(a) the shaping of the leading edge (i.e. the cutting or tearing edge) of each tooth is not critical, as long as the desired flash removal function is fulfilled;

(b) the working clearance between the tip of each tooth 70 and the adjacent opposing surface of the stationary shoe member 24 is not critical, and is typically not greater than 1 to 2 mm, according to the specific design of the apparatus;

(c) the greater the number of teeth spaced around each side of the wheel member 10, the smaller will be the lengths of "flash" removed by each tooth;

(d) the teeth may be made of any suitable material, such as for example, tool steel; and (e) any convenient method of securing the teeth on the wheel member may be used.

The ability of the apparatus to deliver an acceptable output extrusion product from feedstock in loose particulate or communited form is considerably enhanced by causing the radial depth (or height) of the arcuate passageway 48, in a pressure-building zone which lies immediately ahead (i.e. upstream) of the front face 54 of the abutment member 36, to diminish relatively rapidly in a preferred manner in the direction of rotation of the wheel member 10, for example in the manner illustrated in the drawings.

The removable die block 40 is arranged to be circumferentially co-extensive with that zone, and the said progressive reduction of the radial depth of the arcuate passageway is achieved by appropriately shaping the surface 40A of the die block that faces the bottom of the groove 12 in the wheel member 10.

That surface 40A of the die block is preferbly shaped in a manner such as to achieve in the said zone, when the apparatus is operating, a feedstock metal flow pattern that closely resembles that which is achieved when using instead feedstock in solid form. In the preferred embodiment illustrated in the drawings, that surface 40A comprises a plane surface which is inclined at a suitable small angle to a tangent to the bottom of the groove 12 at its point of contact with the abutment member 36 at its front face 54.

That angle is ideally set at a value such that the ratio of (a) the area of the abutment member 36 that is exposed to feedstock metal at the extrusion pressure, to (b) the radial cross-sectional area of the passageway 48 at the entry end of said zone (i.e. at the radial cross-section adjacent the upstream end of the die block 40) is equal to the ratio of (i) the apparent density of the feedstock entering that zone at said entry end thereof, to (ii) the density of the fully-compacted feedstock lying adjacent the front face 54 of the abutment member 36.

In one satisfactory arrangement, the said plane surface 40A of the die block was inclined at an angle such that the said area of the abutment member that is exposed to feedstock metal at the extrusion pressure is equal to one half of the said radial cross-sectional area of the passageway 48 at the entry end of said zone (i.e. at the upstream end of the die block).

If desired, in an alternative embodiment the surface of the die block facing the bottom of the groove 12 may be inclined in the manner referred to above over only a greater part of its circumferential length which extends from the said upstream end of the die block, the part of the die block lying immediately adjacent the front face 54 of the abutment member being provided with a surface that lies parallel (or substantially parallel) with the bottom of the groove 12.

The greater penetration of the die block 40 into the groove 12, which results from the said shaping of the surface 40A referred to above, serves also to offer increased physical resistance to the unwanted extrusion of flash-forming metal through the clearance gaps 32 and 34, so that the amount of feedstock metal going to the formation of such flash is greatly reduced. Moreover, that penetration of the die block into the groove 12 results in reductions in (a) the redundant work done on the feedstock, (b) in the amount of flash produced, and (c) the bending moment imposed on the abutment member by the metal under pressure. Furthermore, the choice of a plane working surface 40A for the die block reduces the cost of producing that die block.

Whereas in the above description, the wheel member 10 is driven by an electric driving motor, at speeds within the stated range, other like-operating continuous extrusion machines may utilise hydraulic driving means and operate at appropriate running speeds.

As an alternative to introducing additional cooling water into the passageway 48 via the sprinklers 65, hopper 52 and passage 50, such additional cooling water may be introduced into that passageway (for example, via a passage 67 formed in the shoe member 24) at a position at which said passageway is filled with particulate feedstock, but at which said particulate feedstock therein is not yet fully compacted.

It is believed that the highly beneficial cooling effects provided by the present invention arise very largely from the fact that the heat absorbed by a part of the wheel member lying temporarily adjacent the hot metal in the confined extrusion zone upstream of the abutment member is conveyed (both by thermal conduction and rotation of the wheel member) from that hot zone to a cooling zone situated downstream of the abutment member, in which cooling zone a copious supply of cooling fluid is caused to flow over relatively large areas of the wheel member passing through that cooling zone so as to extract therefrom a high proportion of the heat absorbed by the wheel member in the hot extrusion zone.

In this cooling zone access to the wheel member is less restricted, and relatively large surfaces of that member are freely available for cooling purposes. This is in direct contrast to the extremely small and confined cooling surfaces that can be provided directly adjacent the extrusion zone in the parts of the said shoe member (i.e. the die block and abutment member) that bound that extrusion zone. As has been mentioned above, the cooling surfaces that can be provided in those parts are severely limited in size by the need to conserve the mechanical strengths of those parts and so enable them to safely withstand the extrusion pressure exerted on them.

The conveying of heat absorbed by the wheel member to the said cooling zone can be greatly enhanced by the incorporation in said wheel member of metals having good thermal conductivities and good specific heats (per unit volume). However, since the said wheel member, for reasons of providing adequate mechanical strength, is made of physically strong metals, (e.g. tool steels), it has relatively poor heat transmission properties. Thus, the ability of the wheel member to convey heat to said cooling zone can be greatly enhanced by incorporating intimately in said wheel member an annular band of a metal having good thermal absorption and transmission properties, for example, a band of copper.

Such a thermally conductive band may conveniently be constituted by an annular band secured in the periphery of the said wheel member and preferably constituting, at least in part, the part of said wheel member in which the said circumferential groove is formed to provide (with the shoe member) the said passageway (48).

In cases where the extrusion product of the machine is of a metal having suitably good thermal properties, the said thermally conductive band may be composed of the same metal as the extrusion product (e.g. copper).

In other cases, said thermally-conductive band may be embedded in, or be overlaid by, a second annular band, which second band is of the same metal as the extrusion product of the machine and is in contact with the tip portion of the said abutment member, the two bands being of different metals.

Metals which may be used for the said thermally-conductive band are selected to have a higher product of thermal conductivity and specific heat per unit volume than tool steel, and include the following (in decreasing order of said higher product):

Copper, silver, beryllium, gold, aluminium, tungsten, rhodium, iridium, molybdenum, ruthenium, zinc and iron.

The rate at which heat can be conveyed by such a thermally-conductive band from the extrusion zone to the cooling zone is dependent on the radial cross-sectional area of the band, and is increased by increasing that cross-sectional area. Thus, for a given cross-sectional dimension measured transversely of the circumference of the wheel member, the greater the radial depth of a said band, the greater the rate at which heat will be conveyed to the cooling zone by the wheel member.

Calculations have shown that for a said wheel member having an effective diameter of 233 mm, and a speed of rotation of 10 RPM, and a said thermally-conductive band of copper having a radial cross-section of U-shape, the rate "R" of conveying heat from the extrusion zone to the said cooling zone by the wheel member, by virtue of its rotation alone, varies in the manner shown below with variation of the radial depth or extent to which a said abutment (36) cooperating with the wheel member penetrates into that copper band, that is to say, with variation of the radial thickness "T" of the copper band that remains at the bottom of the said circumferential groove (12). These calculations were based on a said copper band having with the adjacent parts (tool steel) of the wheel member an interface of generally circular configuration as seen in a radial cross section. Hence, the radial cross-sectional area "A" of the copper band varies in a non-linear manner with the said radial thickness "T" of copper at the bottom of said groove (12).

| T (mm) | A (sq. mm) | R (kW) |
|---|---|---|
| 1.0 | 18.0 | 5.1 |
| 1.5 | 22.7 | 6.4 |
| 2.0 | 27.4 | 7.7 |
| 2.5 | 32.1 | 9.1 |
| 3.0 | 36.8 | 10.4 |

In one practical arrangement having such a wheel member and a 2 mm radial thickness T of said copper band at the bottom of said groove (12), when operating at said wheel member speed and extruding copper wire of 1.4 mm diameter at a speed of 150 meters per minute, heat was extracted from the wheel member and abutment member in said cooling zone at a rate of 10 kW by cooling water flowing at as low a rate of 4 liters per minute and providing at the surfaces to be cooled in said cooling zone a jet velocity of approximately 800 meters per minute.

This heat extraction rate indicates that heat was reaching the cooling zone at a rate of some 2.3 kW as a result of the conduction of heat through the said conductive band, the adjacent wheel member parts, and the abutment member, induced by the temperature gradient existing between the extrusion zone and the cooling zone.

This measured rate of extracting heat by the cooling water flowing in the cooling zone compares very favourably with a maximum rate of heat extraction of some 1.9 kW that has been found to be achievable by flowing cooling water in the prior art manner through internal cooling passages formed in the abutment member.

Figure 6:
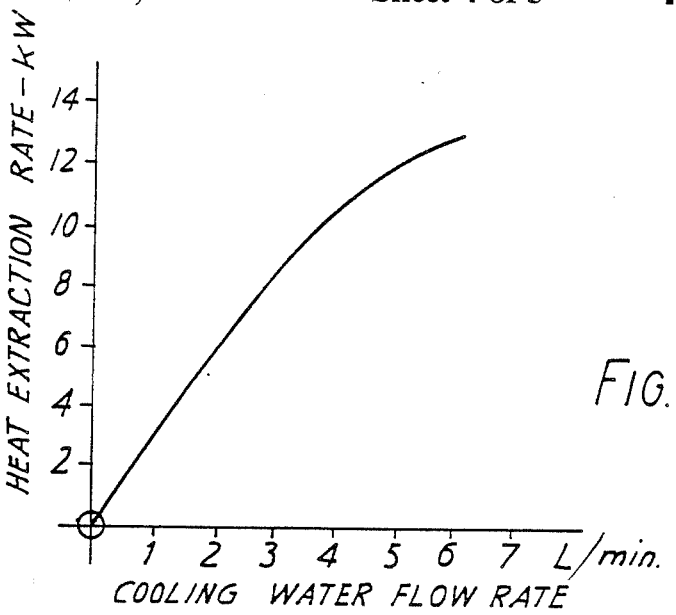
FIG. 6 shows a graph depicting the variation of a heat extraction rate with variation of a cooling water flow rate, as obtained from tests on one apparatus according to the present invention.

FIG. 6 shows the way in which the rate of extracting heat from the wheel member and abutment member in said cooling zone was found to vary with variation of the rate of flow of the cooling water supplied to that zone.

Figure 10:
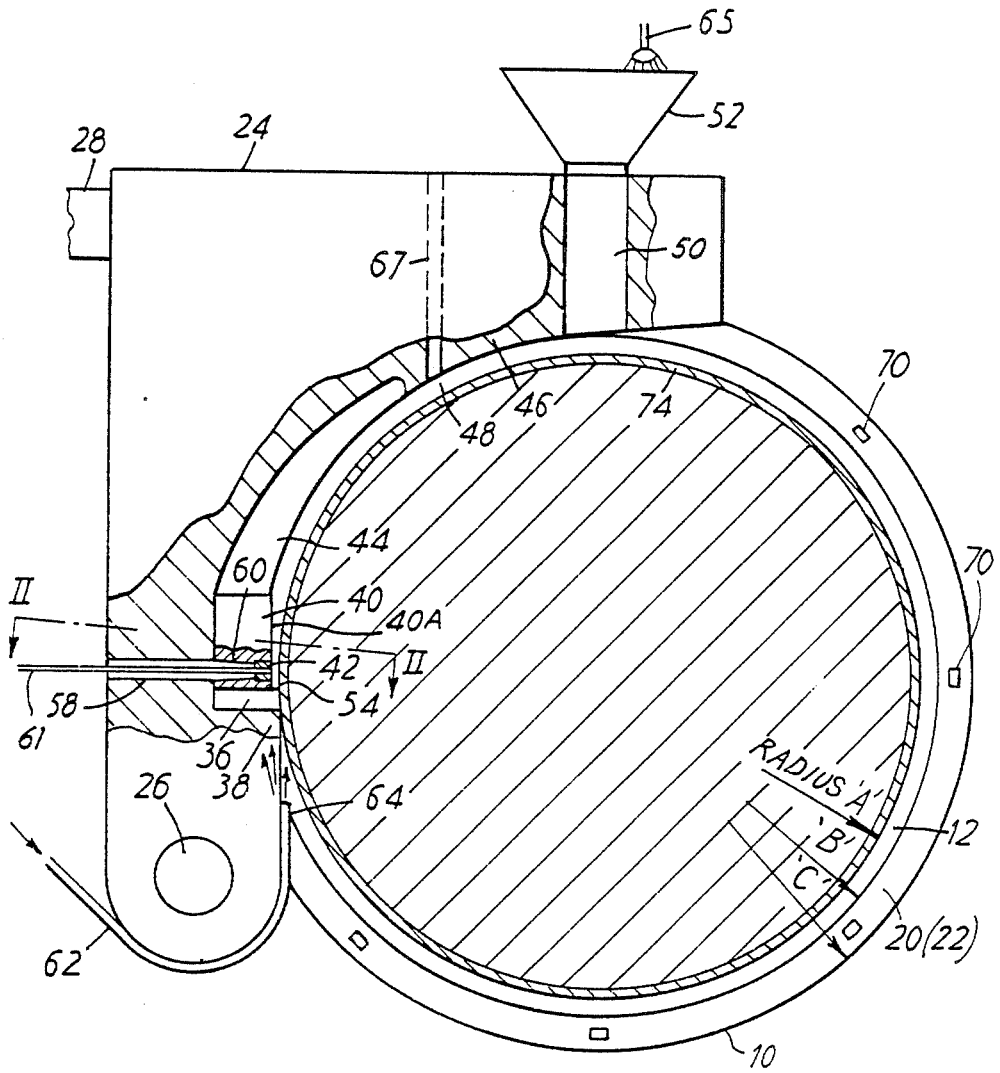
FIG. 10 shows, in a view similar to that of FIG. 1, a modified form of the apparatus shown in the FIGS. 1 and 2.

The extrusion machine described above with reference to the drawings was equipped for the practical tests with a said thermally-conductive band of copper, which band is shown at reference 74 in FIG. 10, and indicated, for convenience only, in dotted-line form in FIG. 2. (It should be noted that FIG. 2 also depicts, when the copper band 74 is represented in full-line form, the transverse sectional view taken on the section indicated in FIG. 10 at II—II.) As will be understood from reference 74 in FIG. 2, the said copper band had a radial cross section of U-shape, which band lined the rounded bottom 16 of the circumferential groove 12 and extended part-way up the parallel side walls of that groove.

Figure 7:
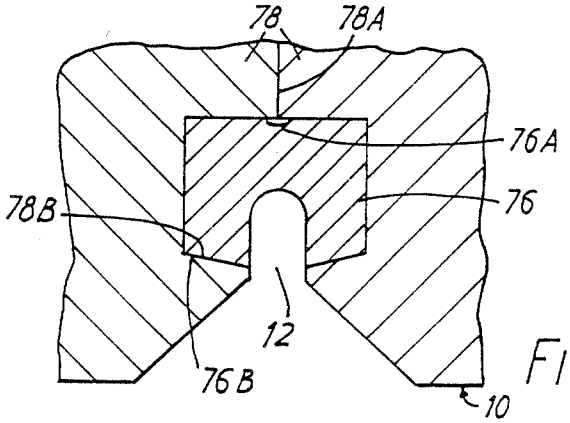

FIG. 7 shows in a view similar to that of FIG. 2 a modification of the wheel member 10. In that modification, a solid annular band 76 of copper having a substantially rectangular radial cross-section is mounted in and clamped securely between cooperating steel cheek members 78 of said wheel member, so as to be driven by said cheek members when a driving shaft on which said cheek members are carried is driven by said driving motor. The band 76 has, at least intially, a small internal groove 76A spanning the tight joint 78A between the two cheek members 78. That groove prevents the entry between those cheek members of any of the metal of said band 76 during assembly of the wheel member 10. Complementary frusto-conical surfaces 76B and 78B on said band and cheek members respectively permit easier assembly and disassembly of those parts of the wheel member 10.

The circumferential groove 12, is formed in the copper band by pivotally advancing the shoe member 24 about its pivot pin 26 towards the periphery of the rotating wheel member 10, so as to bring the tip of the abutment member 36 into contact with the copper band, and thereby cause it to machine the copper band progressively deeper to form said groove 12 therein.

Figure 8:
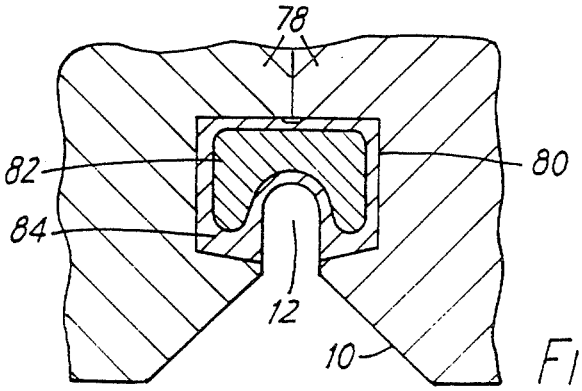

FIG. 8 shows an alternative form of said modification of FIG. 7, in which alternative the thermally-conductive band comprises instead a composite annular band 80 in which an inner core 82 of a metal (such as copper) having good thermal properties is encased in and in good thermal relationship with a sheath 84 of a metal (for example, zinc) which is the same as that to be extruded by the machine.

Figure 9:
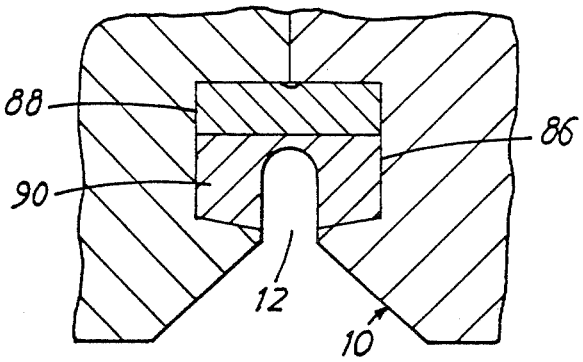
FIGS. 7 to 9 show, in views similar to that of FIG. 2, various modified forms of a wheel member incorporated in said apparatus.

FIG. 9 shows a further alternative form of said modification of FIG. 7, in which alternative the thermally-conductive band comprises instead a composite band 86 in which a radially-inner annular part 88 thereof is made of a metal (such as copper) having good thermal properties and is encircled, in good thermal relationship, by a radially-outer annular part 90 of a metal which is the same as that to be extruded by the machine. Said circumferential groove is machined by said abutment member wholly within said radially-outer part 90 of said band.

Instead of forming the working groove 12 in the peripheral parts of the wheel member 10 by means of the abutment member 36 used in the manner described above, any other equivalent machining tool and process may be used to form that groove 12. For example, the wheel member 10 having the solid annular band 74 (FIG. 2), 76 (FIG. 7), 82/84 (FIG. 8) or 88/90 (FIG. 9) secured in the periphery thereof may be placed in and rotated in a conventional lathe, against the cutting end of a conventional cutting tool. The shape of that cutting end corresponds to that of the abutment member 36 that is to be used with the wheel member so produced.

Metals which can be extruded by extrusion machines as described above include:

Copper and its alloys, aluminium and its alloys, zinc, silver, and gold.

It should be noted that various aspects of the present disclosure which are not referred to in the claims below have been made the subjects of the respective sets of claims of other patent applications all of which likewise claim priority from the same two UK patent applications, Nos. 8309836 (filed Apr. 12, 1983) and 8302951 (filed Feb. 3, 1983).

We claim:

1. A method of producing a rotary wheel member adapted for use in a rotary, friction type, continuous extrusion apparatus having an abutment member, which method comprises the steps of:

(a) producing a rotary wheel having formed in its cylindrical peripheral portion a continuous, radially-extending groove, and secured in that groove for movement with said peripheral portion of said wheel a solid annular metal mass;

(b) rotating said wheel about its rotary axis; and (c) applying to the periphery of said annular metal mass secured in said wheel a tool of predetermined end shape, and progressively advancing said tool in a radial direction as said wheel continues to rotate whereby to machine in the peripheral portion of said annular metal mass a working groove of predetermined desired transverse cross sectional shape;

said peripheral portion of said annular metal mass which defines said working groove being of a composition which is substantially the same as that of a predetermined feedstock metal that is to be extruded in a said apparatus when equipped with the wheel member so produced; and said predetermined end shape of said tool being substantially the same as that of the abutment member which is to be used in that apparatus to close the end of an arcuate passageway which is formed in said working groove by a shoe member which when the apparatus is in operation co-operates with said cylindrical peripheral portion of said wheel member.

2. A method according to claim 1, wherein said annular metal mass secured in said wheel groove is in good thermal relationship with said wheel.

3. A method according to claim 1, wherein said wheel is mounted for rotation in a said rotary extrusion apparatus, and is rotated therein, and said tool comprises said abutment member of said apparatus, which abutment member is advanced radially into said annular metal mass as said wheel is rotated, whereby to form said working groove.

4. A method of producing a rotary wheel member adapted for use in a rotary, friction type, continuous extrusion apparatus having an abutment member, which method comprises the steps of:

(a) producing a rotary wheel having formed in its cylindrical peripheral portion a continuous, radially-extending groove, and secured in that groove for movement with said peripheral portion of said wheel a solid annular metal mass comprising concentric inner and outer annular bands of first and second predetermined metals, respectively, which lie in good thermal relationship with one another;

(b) rotating said wheel about its rotary axis; and (c) applying to the periphery of said solid annular metal mass secured in said wheel a tool of predetermined end shape, and progressively advancing said tool in a radial direction as said wheel continues to rotate and thus to machine in said outer annular band of second predetermined metal a working groove of predetermined transverse cross sectional shape;

said outer band of metal having a composition which is substantially the same as that of a predetermined feedstock metal that is to be extruded in said apparatus when equipped with the wheel member so produced; and said predetermined end shape of said tool being substantially the same as that of the abutment member which is to be used in that apparatus to close the end of an arcuate passageway which is formed in said working groove by a shoe member which, when the apparatus is in operation, cooperates with said cylindrical peripheral portion of said wheel member.

5. A method according to claim 4, wherein said inner band of first predetermined metal is wholly overlaid by said outer band of second predetermined metal.

6. A method according to claim 5, wherein said first and second predetermined metals each have a product of thermal conductivity and specific heat per unit volume that is greater than that of the material of the wheel.

7. A method according to claim 6, wherein said product for said first predetermined metal is greater than that for said second predetermined metal.

8. A method according to claim 5, wherein said inner band of first predetermined metal is wholly sheathed within an inner part of said outer band of second predetermined metal.

9. A method according to claim 8, wherein said first and second predetermined metals each have a product of thermal conductivity and specific heat per unit volume that is greater than that of the material of the wheel.

10. A method according to claim 9, wherein said product for said first predetermined metal is greater than that for said second predetermined metal.

11. A method according to claim 4, wherein said wheel is mounted for rotation in said rotary extrusion apparatus, and is rotated therein, and said tool comprises said abutment member of said apparatus, which abutment member is advanced radially into said outer band of second predetermined metal as said wheel is rotated, whereby to form said working groove.

12. A wheel member which is substantially the same as that prepared by a method according to any of claims 4 to 11.

13. A process for manufacturing apparatus for effecting continuous extrusion of metal from feedstock metal, which apparatus comprises:

(a) a rotatable wheel member arranged for rotation when in operation by a driving means, said wheel member having formed peripherally thereon a continuous circumferential groove;

(b) a cooperating shoe member which extends circumferentially around a substantial part of the periphery of said wheel member and which has a portion which projects in a radial direction partly into said groove with small working clearance from the side walls of said groove, said shoe member portion defining with the walls of said groove an enclosed passageway extending circumferentially of said wheel member;

(c) feedstock inlet means disposed at an inlet end of said passageway for enabling feedstock to enter said passageway at said inlet end whereby to be engaged and carried frictionally by said wheel member, when rotating, towards the opposite, outlet end of said passageway;

(d) an abutment member carried on said shoe member and projecting radially into said passageway at said outlet end thereof so as to substantially close said passageway at that end and thereby impede the passage of feedstock frictionally carried in said groove by said wheel member, thus creating an extrusion pressure in said passageway at said outlet end thereof; and (e) a die member carried on said shoe member and having a die orifice opening from said passageway at said outlet end thereof, through which orifice feedstock carried in said groove and frictionally compressed by rotation of said wheel member, when driven, is compressed and extruded in continuous form, to exit from said shoe member via an outlet aperture; the process being characterized by steps for producing said wheel member, which steps comprise:

(i) producing a rotary wheel having formed in its cylindrical peripheral portion a continuous, radially-extending groove, and secured in that groove for movement with said peripheral portion of said wheel a solid annular metal mass;

(ii) rotating said wheel about its rotary axis; and (iii) applying to the periphery of said solid annular metal mass secured in said wheel a tool of predetermined end shape, and progressively advancing said tool in a radial direction as said wheel continues to rotate whereby to machine in the peripheral portion of said annular metal mass a working groove of predetermined transverse cross sectional shape;

said peripheral portion of said annular metal mass which defines said working groove being of a composition which is substantially the same as that of a predetermined feedstock metal that is to be extruded in said apparatus when equipped with the wheel member so produced; and said predetermined end shape of said tool being substantially the same as that of the abutment member which is to be used in that apparatus to close the end of said arcuate passageway which is formed in said working groove by a said show member which, when the apparatus is in operation, cooperates with said cylindrical peripheral portion of said wheel member.

* * * * *